US005833582A

United States Patent [19]

Chen

[11] Patent Number: 5,833,582

[45] Date of Patent: Nov. 10, 1998

[54] BODY EXERCISER

[76] Inventor: George Chen, 3th Fl., 8, Ta Yung San Street, Chung Li City, Taiwan

[21] Appl. No.: 939,654

[22] Filed: Sep. 29, 1997

[51] Int. Cl.[6] ..... A63B 22/06; A63B 26/00; A63B 21/015

[52] U.S. Cl. ..... 482/57; 482/142; 482/121; 482/115; 482/51

[58] Field of Search ..... 482/52, 56, 83, 482/51, 142, 148, 904, 138

[56] References Cited

U.S. PATENT DOCUMENTS

| | | | |
|---|---|---|---|
| 4,569,401 | 2/1986 | Luck | 482/83 X |
| 5,054,773 | 10/1991 | Parviainen | 482/138 X |
| 5,163,886 | 11/1992 | Seal | 482/57 |
| 5,263,915 | 11/1993 | Habing | 482/138 X |
| 5,299,792 | 4/1994 | Wilkenson | 482/52 |
| 5,342,265 | 8/1994 | Credman | 482/57 |
| 5,549,527 | 8/1996 | Yu | 482/57 |
| 5,549,530 | 8/1996 | Fulks | 482/138 X |

*Primary Examiner*—Stephen R. Crow
*Assistant Examiner*—William LaMarca
*Attorney, Agent, or Firm*—Rosenberg, Klein & Bilker

[57] ABSTRACT

A body exerciser including a base, a connecting seat, a pendulum device, and a beam device. The base is provided with lugs and opposed curved slide tracks at a lower side thereof. The extent of movement of the connecting seat is controlled by a hydraulic lever. The pendulum device is pivotally provided at the lugs of the base and includes a gravity pendulum. The axle of the gravity pendulum is provided with unidirectional sprockets. A pair of pedals are respectively mounted at both ends of the axle. The beam device includes a frame connected to the pendulum device for linking-up movement. The frame has slide wheels at both ends respectively for mounting on the slide tracks of the base. The frame is provided with idle sprockets and chains for driving the unidirectional sprocket. One end of the chain is connected to a spring and secured to the frame. The other end of the chain projects from the frame and connected to a fastening ring to which an attachment ring of a cable may be fastened. That end of the frame opposite to the fastening ring is provided with an insertion stem for receiving an auxiliary lever.

4 Claims, 10 Drawing Sheets

BODY EXERCISER

BACKGROUND OF THE INVENTION (a) Field of the Invention

The present invention relates generally to a body exerciser, and more particularly to a universal body exerciser that allows the user to perform various kinds or forms of exercises.

(b) Description of the Prior Art

Conventional exercising apparatuses generally have only a single function. People have to buy different types of exercising apparatus in order to be able to do various kinds of exercises. This is very costly and space-occupying.

SUMMARY OF THE INVENTION

A primary object of the present invention is to provide a body exerciser equipped with foot pedal means.

Another object of the present invention is to provide a body exerciser whereby the user can perform sit-up exercises.

A further object of the present invention is to provide a body exerciser whereby the user can train the leg muscles.

Still another object of the present invention is to provide a body exerciser whereby the user can perform pulling exercises.

Yet another object of the present invention is to provide a body exerciser whereby the user can train the chest muscles.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
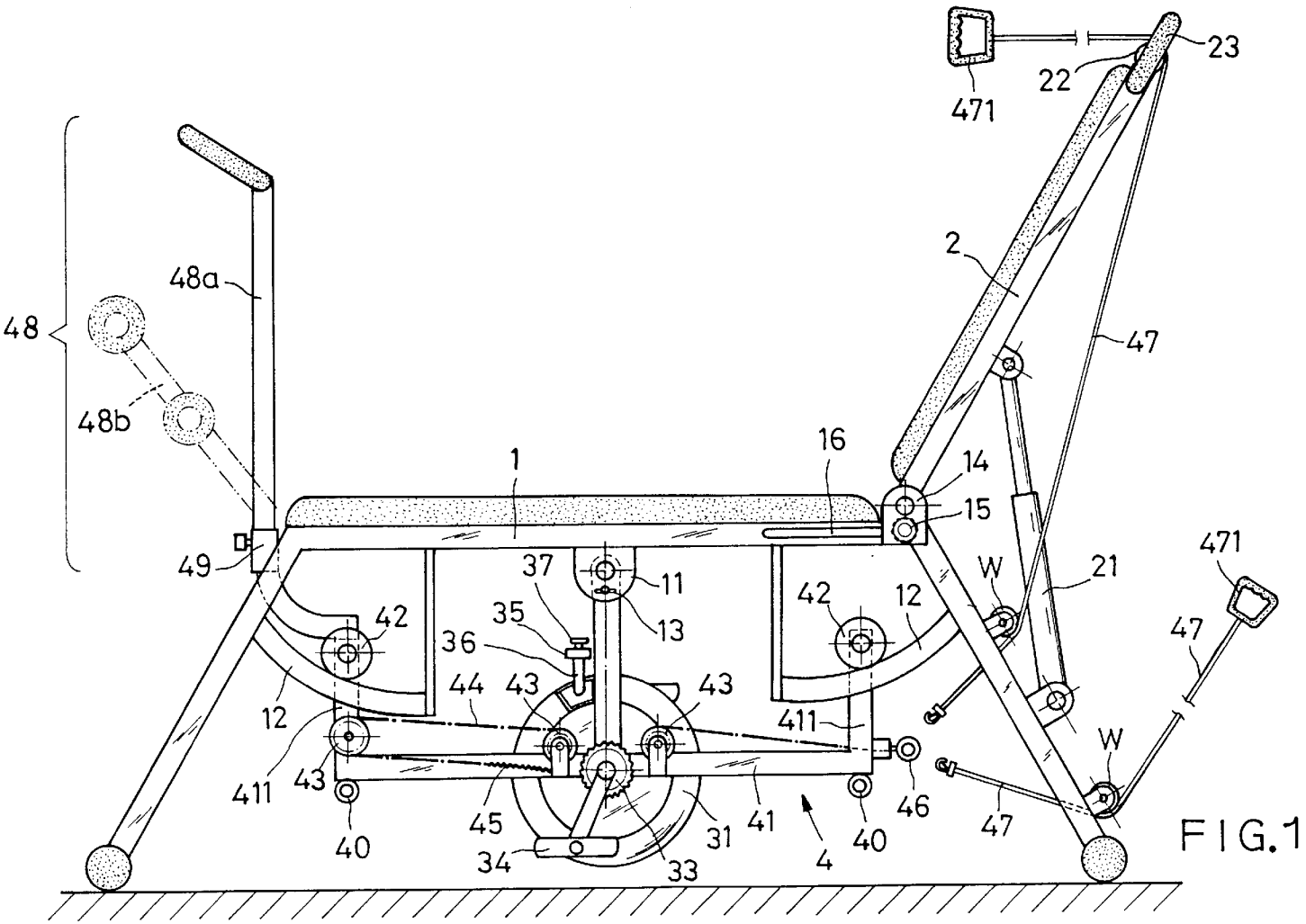
FIG. 1 is a side view of a preferred embodiment of the present invention.

With reference to FIGS. 1–5, the present invention essentially comprises a base 1, a connecting seat, a pendulum device, and a beam device 4. The base 1 is substantially arcuate and is provided with lugs and opposed, curved slide tracks 12. The connecting seat 2 has a bottom end pivotally connected to positioning seats 14 at both sides of a rear end of the base 1, and a back portion the movement of which is controlled by a hydraulic lever 21 pivotally provided on the base 1, the connecting seat 2 providing a load for exercising purposes and being further provided with two guide wheels 22 at an upper end with a handle 23 at either side. The pendulum device 3 is pivotally provided at the lugs 11 below the base 1, and includes a gravity pendulum 31 having an axle 32, unidirectional sprockets 33 on the ends of the axle 32; a pair of foot pedals respectively mounted at the two ends of the axle 32; a positioning plate 35 disposed in front of the pendulum device 3; a clamp type brake 36 provided below the positioning plate 35; and a pull lever 37 disposed above the positioning plate 35 for controlling the brake 36 to brake the gravity pendulum 31. The beam device 4 includes a substantially U-shaped frame 41 connected to the pendulum device 3 for linking-up movement and having two vertical portions 411 at both sides; a pair of slide wheels 42 disposed at the vertical portions 411 of the frame 41 and mounted on the curved slide tracks 12 of the base 1; a predetermined number of idle sprockets 43 provided on the frame 41 at predetermined positions; chains 44 for driving the unidirectional sprocket 33; a spring 45 connected to one end of the chain 44 and secured to the frame 41 at a determined position; fastening rings 46 each connected to the other end of the chains 44 that projects from the frame 41; a cable 47 to be connected to the fastening rings 46; and an insertion stem 49 disposed at that vertical portion 411 of the frame opposite to where the fastening rings 46 are, for receiving an auxiliary lever 48 which can be of any desirable form.

Figure 2:
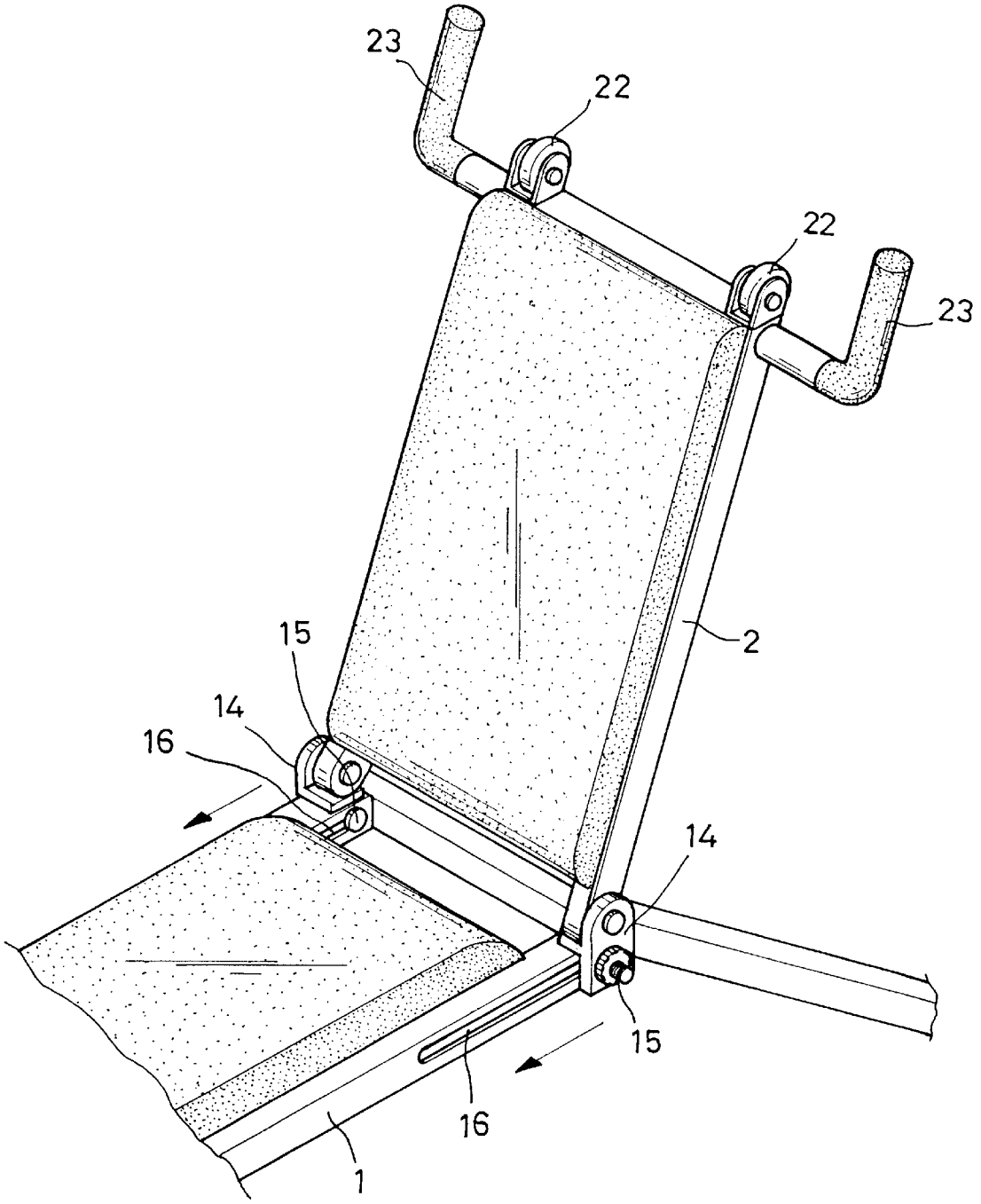
FIG. 2 is a perspective view of the structure of the connecting seat according to the present invention.

Referring to FIG. 2, the positioning seats 14 pivotally connected to the bottom end of the connecting seat 2 are respectively locked in elongated slots 16 at one sides of the base 1 to allow adjustment of the position of the connecting seat 2.

Figure 3:
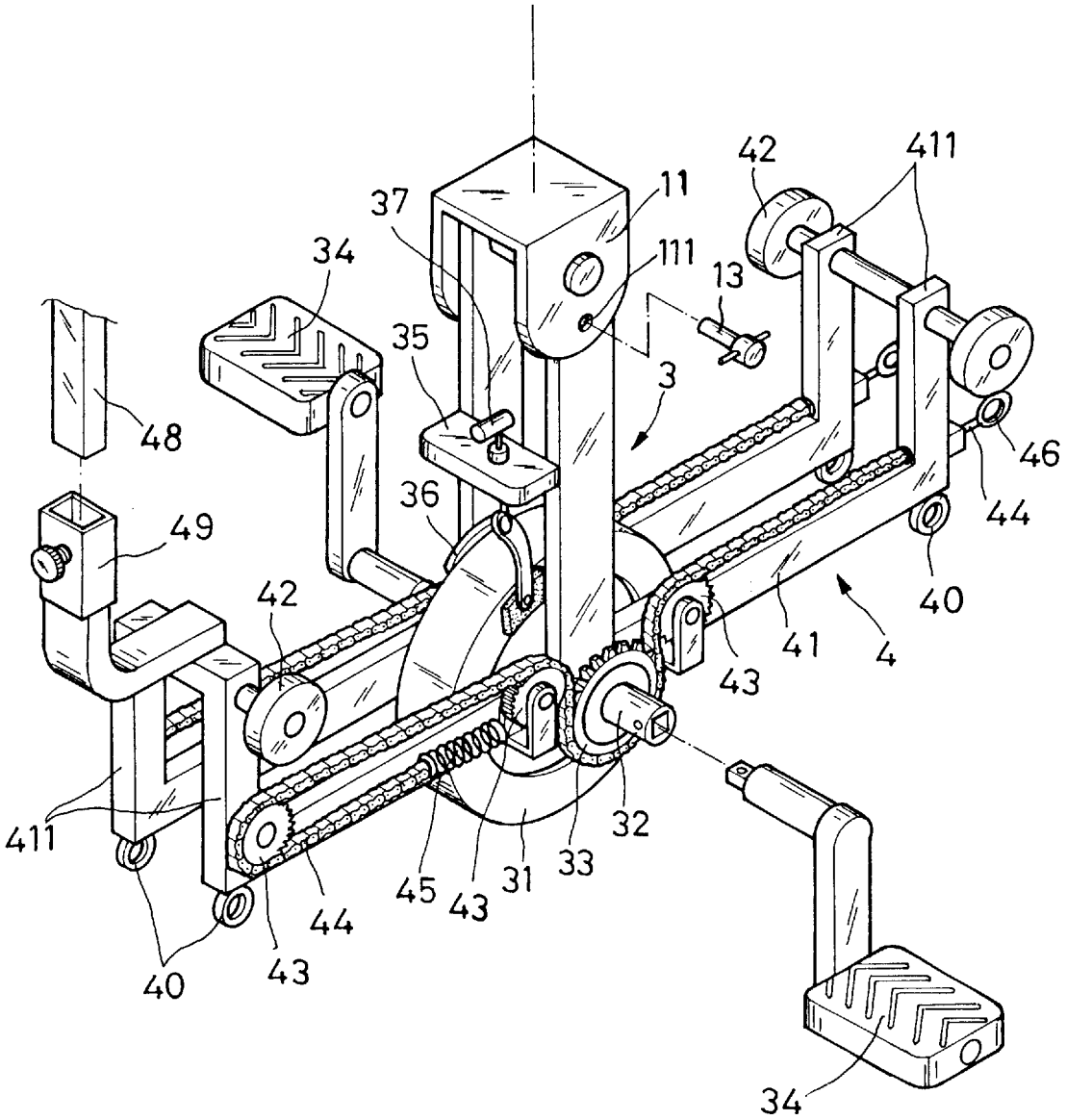
FIG. 3 is a perspective view of the structure of the pendulum device and beam device according to the present invention.
Figure 4:
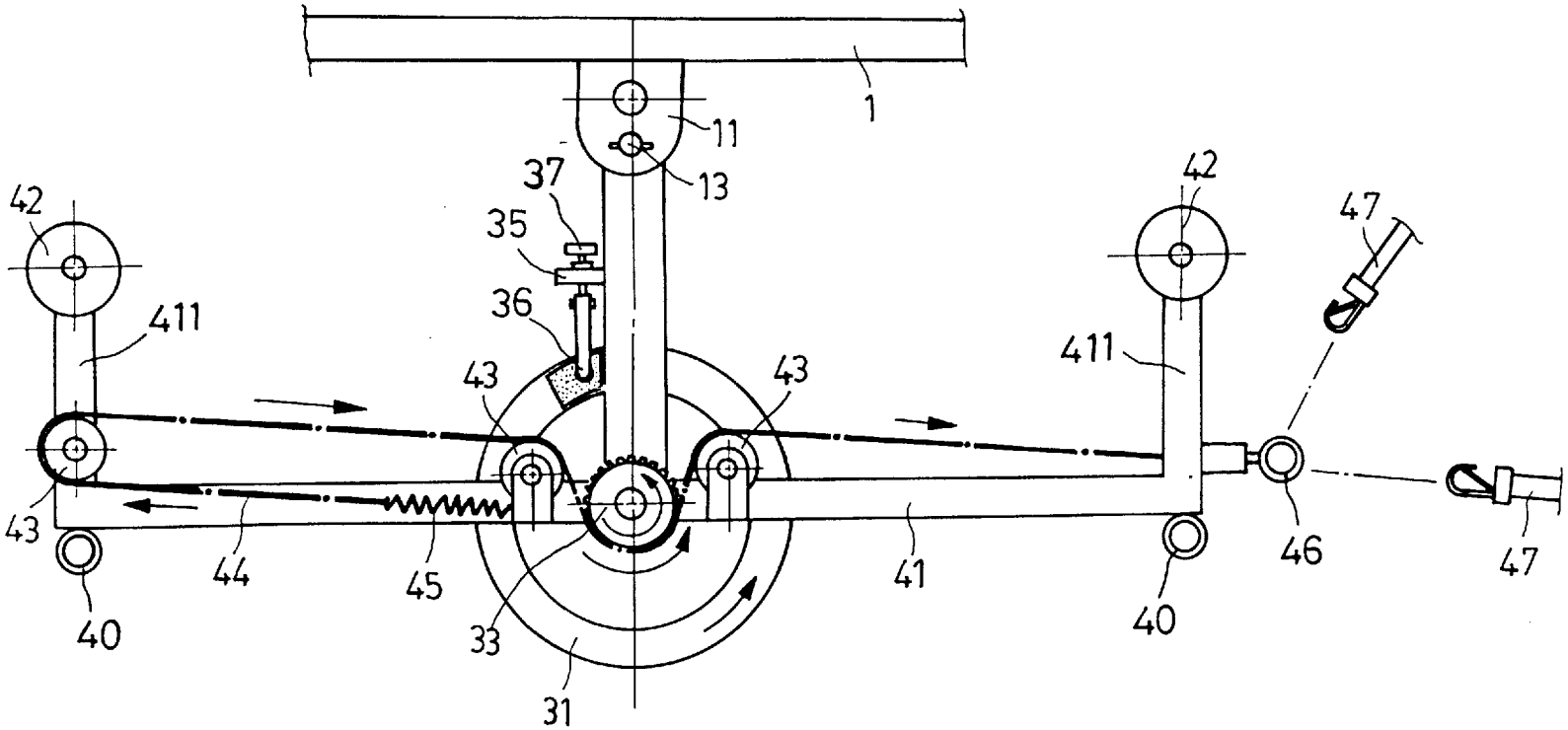
FIG. 4 is a schematic view showing the state of the invention in which the pendulum device is stationary and the gravity pendulum provides a load.
Figure 5:
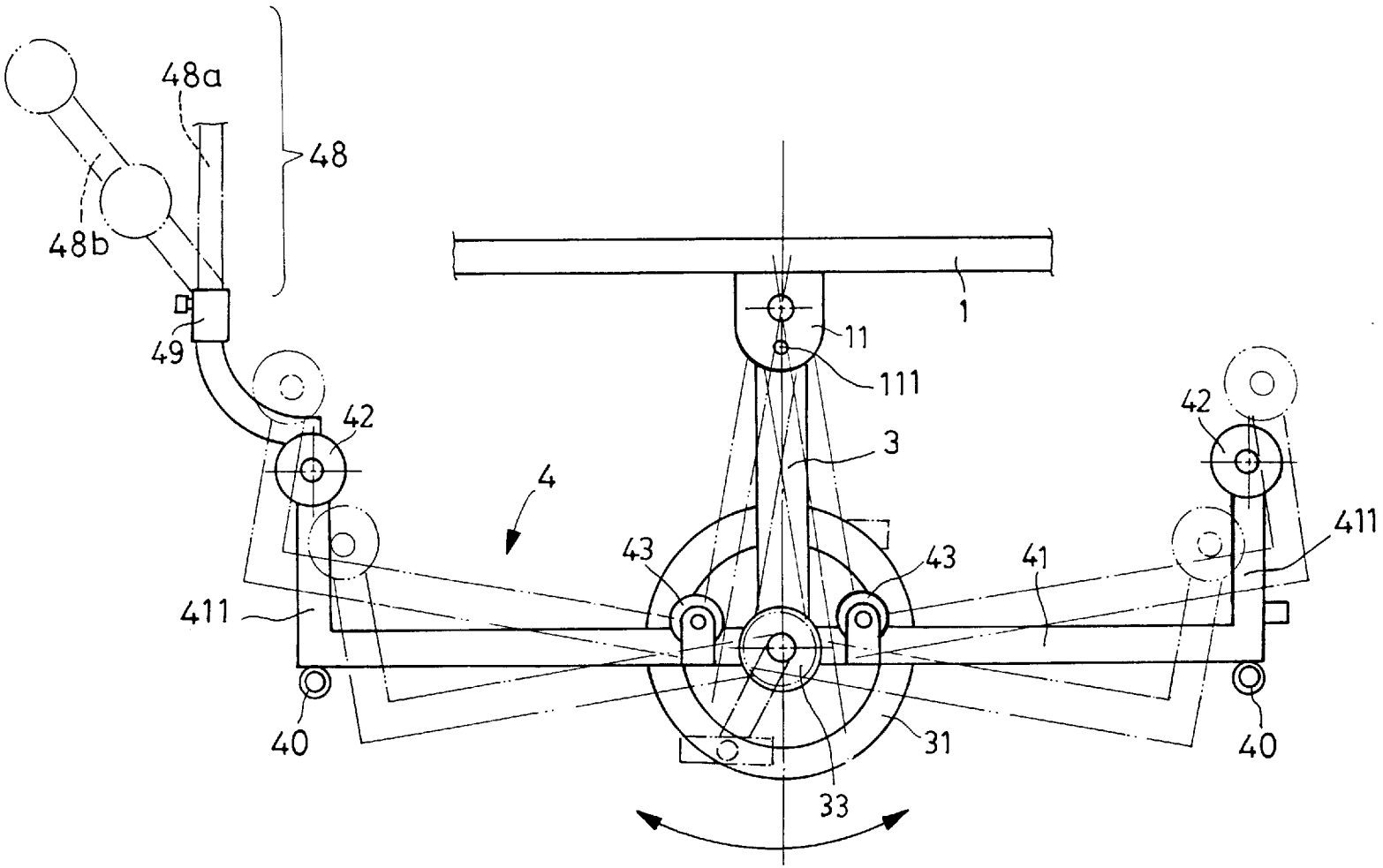
FIG. 5 is a schematic view showing the state of the invention in which the pendulum device swings and the gravity pendulum provides a load.

Referring to FIG. 3, positioning pins 13 are provided between the pendulum device 3 and the lugs 11 on which it is pivotally mounted for securing the pendulum device 3 when the pendulum device 3 is not in use. The positioning pins 13 are inserted into positioning hole 111 of the lugs 11 to stop the pendulum device 3 from moving.

The cable 47 is provided with an attachment ring 471 which may be fastened at various positions of the exerciser with the cable 47 passing around idle wheels w at different positions to allow the user to perform pull and push exercises.

The beam device 4 is provided with securing rings 40 at both ends at the bottom side to which the cable 47 may be fastened to pull the beam device 4 to swing.

The auxiliary lever 48 may be a hand grip 48*a* or a foot rest 48*b* or means of other functions.

The technical features and advantages of the invention are described hereinbelow.

The gravity pendulum 31 acts as a load device. The positioning pins 13 on the lugs 11 control the movement of the pendulum device 3. When the pendulum device 3 is fixed and prevented from moving by the positioning pins 13, by working the foot pedals 34 or pulling the cable 47 to cause the chains 44 to drive the unidirectional sprockets 33 to turn the gravity pendulum 31. When the pendulum device 3 freely swings, by pulling the hand grip 48*a* or working the foot rest 48*b* optionally fitted into the insertion stem 49 at one vertical portion 411 of the beam device 4, due to the linking-up movement of the frame 41 and the pendulum device 3, the beam device 4 may swing back and forth along the curved slide tracks 12 with the gravity pendulum 31 serving as the load. Furthermore, the pedals 34 may be worked to cause the gravity pendulum 31 to swing back and forth.

Figure 6:
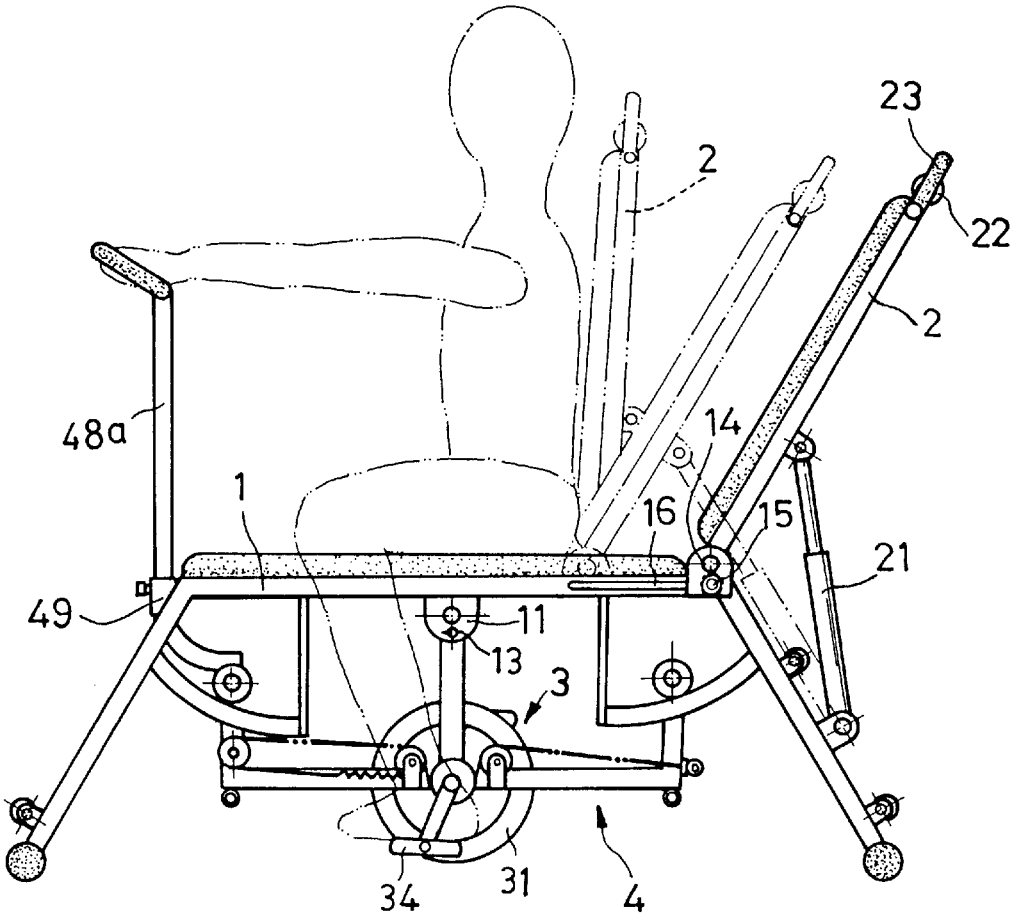
FIG. 6 is a schematic view (I) showing the present invention in use.
Figure 7:
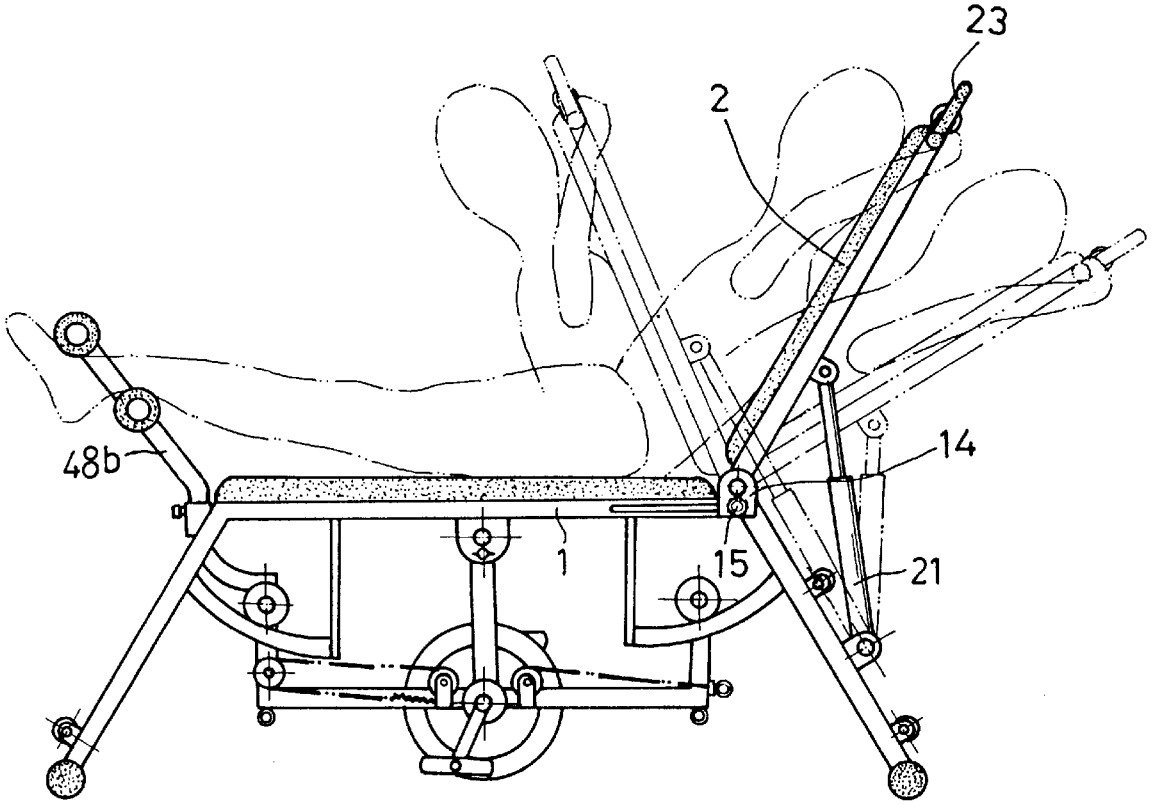
FIG. 7 is a schematic view (II) showing the present invention in use.
Figure 8:
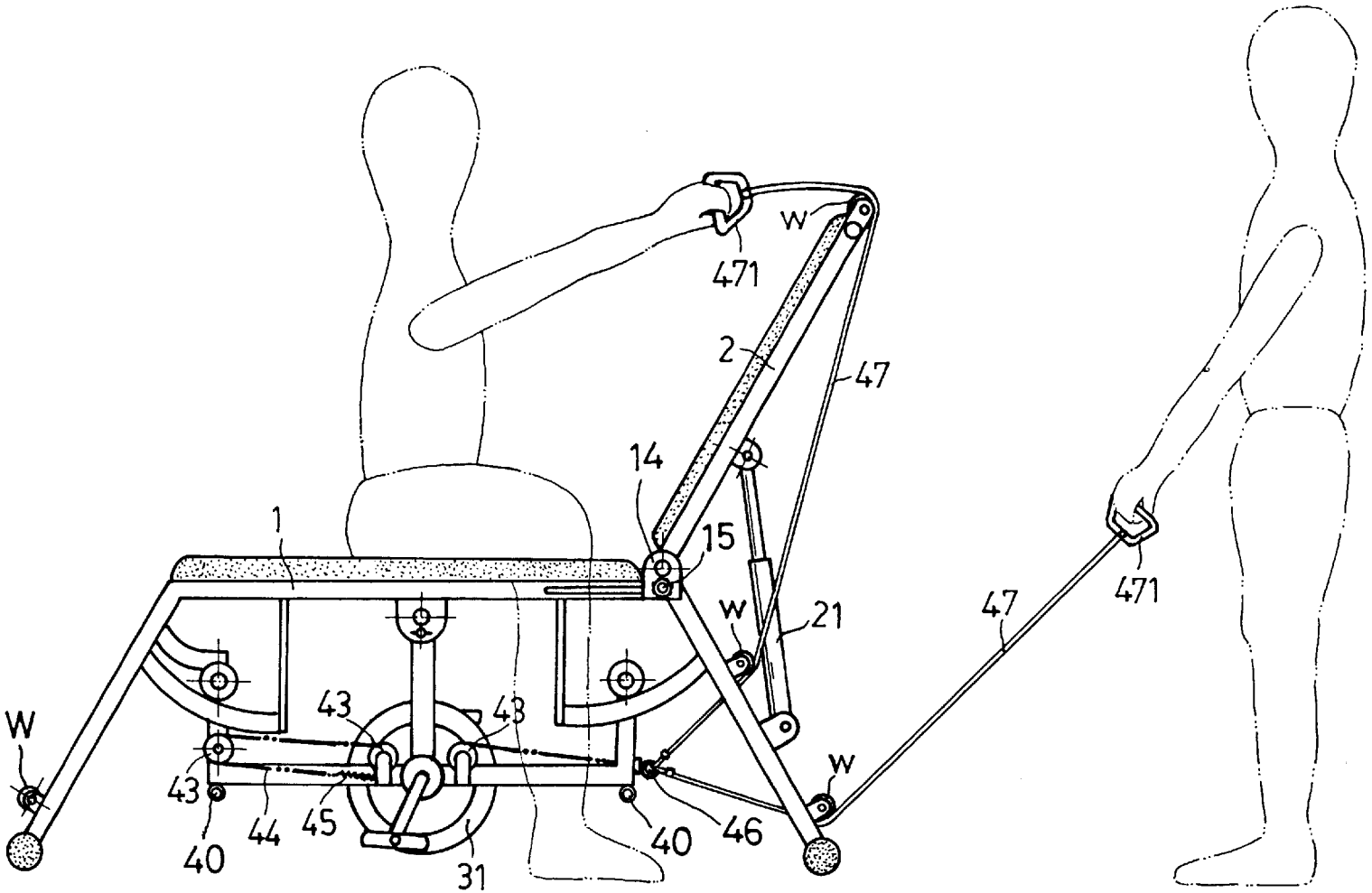
FIG. 8 is a schematic view (III) showing the present invention in use.
Figure 9:
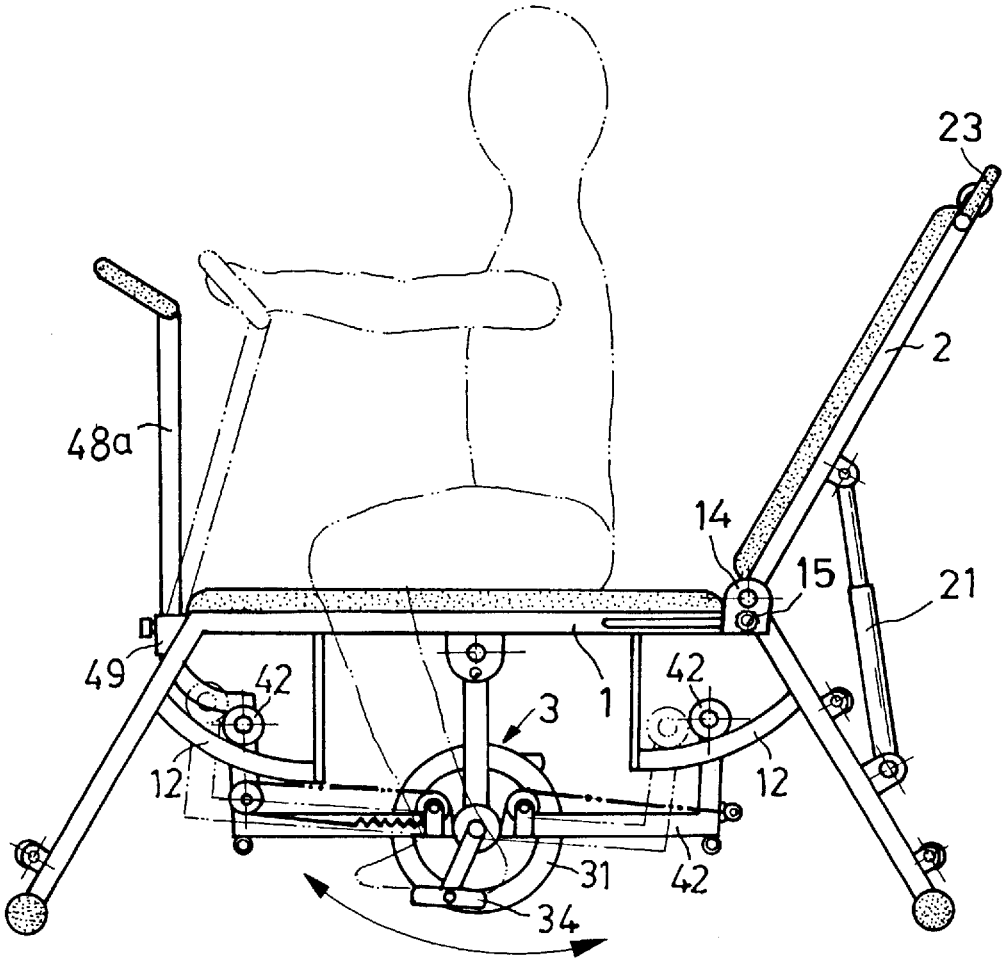
FIG. 9 is a schematic view (IV) showing the present invention in use.
Figure 10:
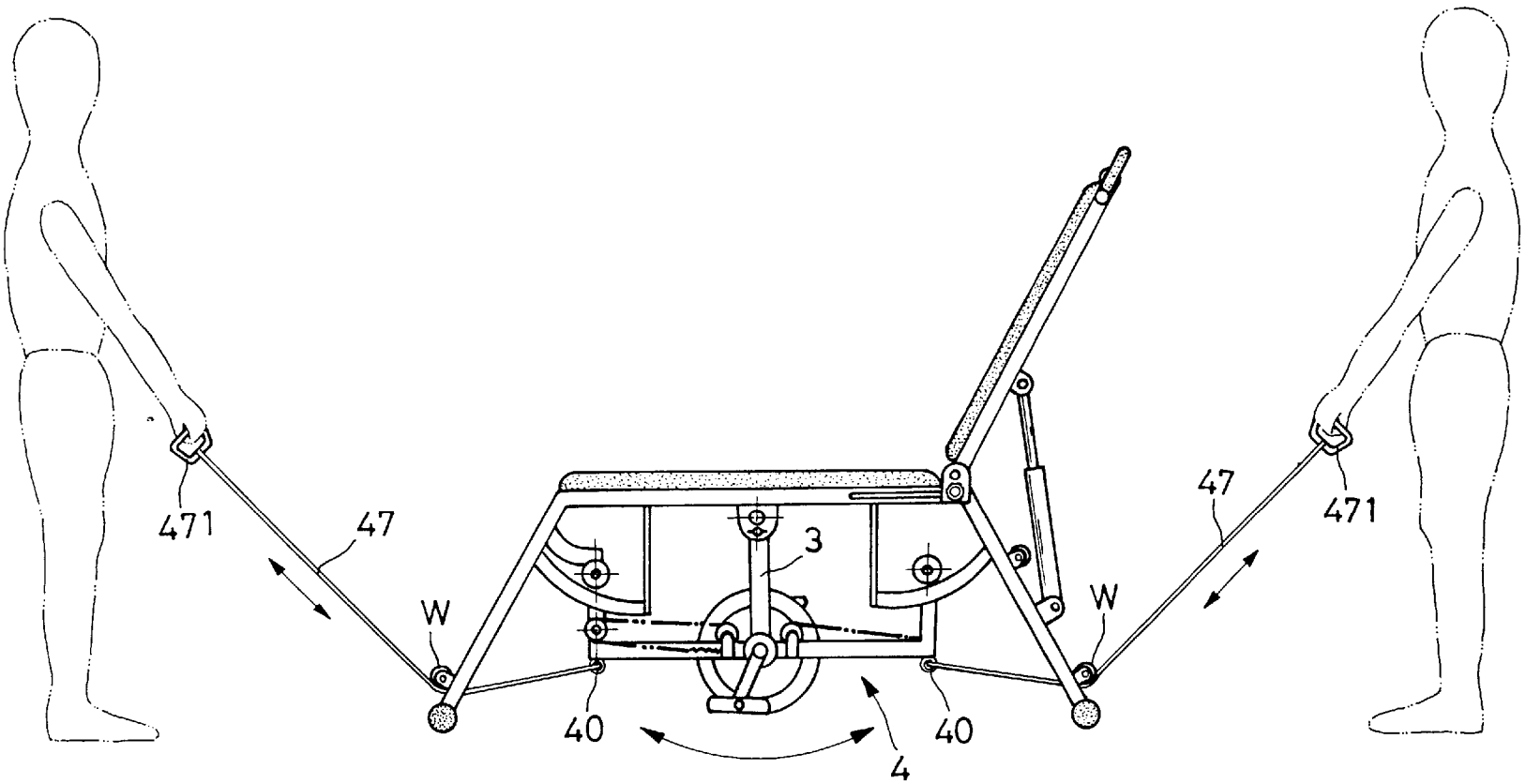
FIG. 10 is a schematic view (V) showing the present invention in use.

Operation of the body exerciser of the invention is further described with reference to FIGS. 6–10. Referring to FIG. 6, when the pendulum device 3 is stationary and the hand grip 48*a* is fitted into the insertion stem 49 of the beam device 4, the user may drive the foot pedals 34 like driving an exer-bike the stretched spring 45 overcoming the unidirectional sprocket 33 to rotate freely while chain 44 is displaced in a reverse direction by spring 45. The positioning seat 14 may be pushed forwardly along the elongated slot 16 to support the back of the user. Positioning bolts 15 are used to lock the positioning seat 14 fixedly in position. Referring to FIG. 7, when the foot rest 48*b* is mounted in the insertion stem 49, the user may perform sit-ups with the help of the foot rest 48*b*. Referring to FIG. 8, as the cable 47 may be fastened to the fastening ring 46 of the chain 44 at various positions and passing around a certain number of idle wheels W, the user may perform pulling to train his/her arm and chest muscles. The arrangement of the spring 45 causes the unidirectional sprocket 33 to perform idle rotation relative to the gravity pendulum when the chain 44 retreats so that there is no load and the cable 47 can be quickly retrieved. Furthermore, when the pendulum device 3 freely swings (i.e., when the positioning pins 13 are removed from the positioning holes 111), the user may straddle on the base 1 with the feet on the foot pedals 34 and the hands holding the hand grip 48*a* to perform rocking exercises. Referring to FIG. 10, the pendulum device 3 freely swings and the cable 47 is fastened to the mounting ring 40 at the bottom side of the frame 41 to allow the user to pull the beam device 4 as a pulling exercise.

In summary, the body exerciser of the invention allows the user to perform various exercises such as sit-up, pedaling, pulling, and other kinds of exercise the user desires. The present invention is indeed a universal body exerciser.

Although the present invention has been illustrated and described with reference to the preferred embodiment thereof, it should be understood that it is in no way limited to the details of such embodiment but is capable of numerous modifications within the scope of the appended claims.

What is claimed is:

1. A body exerciser comprising: a base, being substantially arcuate and provided with lugs and opposed, curved slide tracks;

a connecting seat having a bottom end pivotally connected to positioning seats at both sides of a rear end of said base, and a back portion the movement of which is controlled by a hydraulic lever pivotally provided on said base, said connecting seat providing a load for exercising purposes and being further provided with two guide wheels at an upper end with handles at both sides respectively;

a pendulum device, being pivotally provided at said lugs below said base, and including a gravity pendulum having an axle, unidirectional sprockets on the ends of said axle; a pair of foot pedals respectively mounted at the two ends of said axle; a positioning plate disposed in front of said pendulum device; a clamp type brake provided below said positioning plate; and a pull lever disposed above said positioning plate for controlling said brake to brake said gravity pendulum;

a beam device, including a substantially U-shaped frame connected to said pendulum device for linking-up movement and having two vertical portions at both sides;

a pair of slide wheels disposed at said vertical portions of said frame and mounted on said curved slide tracks of said base; a predetermined number of idle sprockets provided on said frame at predetermined positions; chains for driving said unidirectional sprocket; a spring connected to one end of said chain and secured to said frame at a determined position; fastening rings each connected to the other end of said chains that projects from said frame; a cable to be connected to said fastening rings; and insertion stems disposed at that vertical portion of said frame opposite to where said fastening rings are, for receiving an auxiliary lever.

2. A body exerciser as defined in claim 1, wherein positioning pins are disposed between said pendulum device and said lugs for securing said pendulum device so that said pendulum device is prevented from swinging when not in use.

3. A body exerciser as defined in claim 1, wherein said cable with said attachment ring may be fastened to various positions of said body exerciser and passing around a certain number of idle wheels to allow different forms of pulling exercises.

4. A body exerciser as defined in claim 1, wherein said auxiliary lever may be a hand grip or a foot rest.

* * * * *